US006117273A

United States Patent [19]

Flavio et al.

[11] Patent Number: 6,117,273

[45] Date of Patent: Sep. 12, 2000

[54] MECHANICAL STRAINER FOR FIBROUS SUSPENSIONS

[75] Inventors: Magaraggia Flavio, Vicenza; Aver Franco, Valli del Pasubio, both of Italy

[73] Assignee: Comer SpA, Caltrano, Italy

[21] Appl. No.: 09/225,497

[22] Filed: Jan. 6, 1999

[30] Foreign Application Priority Data

Jan. 22, 1998 [IT] Italy ..... VI98A0008

[51] Int. Cl.[7] ..... D21C 7/00; D21C 3/22; D21C 5/00; D21C 9/02; D06B 3/00

[52] U.S. Cl. ..... 162/251; 162/58; 162/57; 162/56; 162/60; 68/181 R; 210/415; 209/273; 209/306

[58] Field of Search ..... 68/181 R; 210/415, 210/498; 209/250, 273, 306, 300; 162/251, 60, 57, 58, 56

[56] References Cited

U.S. PATENT DOCUMENTS 3,953,325 4/1976 Nelson ..... 209/273

5,497,886 3/1996 Young et al. ..... 209/270

*Primary Examiner*—Stanley S. Silverman
*Assistant Examiner*—Dionne A. Walls
*Attorney, Agent, or Firm*—Watson Cole Grindle Watson, P.L.L.C.

[57] ABSTRACT

The invention realizes an improved mechanical strainer for fibrous suspensions including: a rotor; a filtering basket substantially coaxial externally to said rotor; an interspace defined between the side surfaces of said rotor and of said filtering basket; an outer casing suitable to house said filtering basket and said rotor. Inside this outer casing there are: a feeding chamber receiving the fibrous suspension to be treated, a delivery chamber of the "accepted" and a waste chamber of the "waste". The rotor is provided with a plurality of diffusing ducts developing through diverging ways according to the flow direction and being suitable to pipe the fibrous suspensions to be treated from said feeding chamber to said interspace.

9 Claims, 3 Drawing Sheets

MECHANICAL STRAINER FOR FIBROUS SUSPENSIONS

The invention concerns an improved mechanical strainer for fibrous suspensions, particularly suitable to separate foreign bodies and contraries polluting aqueous suspensions of fibres which are used for paper manufacture. It is known that in order to separate foreign bodies and contraries polluting aqueous suspensions of fibres, as for example the suspensions which are used in paper industry, special mechanical strainers are used. The latter are provided with filtering baskets equipped with holes or with gauged fissures, through which goes the suspension to be treated, piped in the filtering basket through pumps.

The part going through the filtering surface is defined in the field jargon as "accepted" and is sent to the following manufacturing. Instead the part which does not go through the filtering surface, in the field jargon is defined as "waste" and is eliminated.

The mechanical strainers of a known type, which are used for the abovementioned aims, are realized with different shapes but all of them have the drawback that the passing of the fibrous suspension through the filtering surface is not easy because of the clogging of the filtering surface itself taking place most of all when excessive filtering of suspensions with an high fibrous elements concentration are carried out.

In order to reduce possible cloggings, in some realizations of a known type in the filtering basket there is a rotor having the double aim of keeping the suspension mixed and at the same time of keeping the basket lateral surface clean so that the filtering power of the strainer is kept constant as long as possible.

Even providing the strainer with a rotating basket, the filtering surface cannot be kept perfectly clean anyhow. Said filtering surface always reveals, during the manufacturing, a tendency to clog, the thicker the treated suspensions are. Precisely all the strainers of a known type, whatever their executive shape is, have clogging problems when the solids concentration in the suspension to be treated reaches 2%.

The present invention intends to overcome the said drawbacks.

Precisely one of the aims of the present invention is that of realizing an improved mechanical strainer for fibrous suspensions which can work without clogging with suspensions having higher fibres concentrations than those which are workable using strainers of a known type.

Another aim is that the improved mechanical strainer of the invention allows the treatment, with respect to mechanical strainers of a known type, of an higher quantity of suspension in the unit of time.

The said aims are achieved through the realization of an improved mechanical strainer for fibrous suspensions that according to the main claim includes:

- a rotor with a substantially vertical longitudinal axis, provided with a central shaft mechanically connected to motorization means suitable to impart a rotation to it;
- a filtering basket substantially coaxial externally to said rotor and provided with a plurality of openings made on its side surface;
- an interspace defined between the side surfaces of said rotor, and of said filtering basket;
- an outer casing suitable to house said filtering basket and said rotor, in which there are:
  - a feeding chamber defined in the upper part of said casing communicating with a feeding piping of the fibrous suspension to be treated and with said annular interspace;

- a delivery chamber defined in correspondence with the side surface of said filtering basket, communicating with the outer environment through a delivery piping;
  - a waste chamber defined in the lower part of said casing, communicating directly with said interspace and through a waste piping with the outer environment, characterized in that said rotor is provided with a plurality of diffusing ducts each one developing between an inlet section realized in the upper base of said rotor defining said feeding chamber, and an outlet section realized on the lateral surface of the rotor itself defining said interspace, said ducts being suitable to pipe the fibrous suspensions to be treated from said feeding chamber to said interspace.

According to a preferred embodiment each one of said diffusing ducts is defined laterally by curved surfaces that, beginning from the respective input section of the diffusing duct, develop through diverging ways toward the respective output section, the latter having a larger area with respect to the area of said input section.

Each diffusing duct, moreover, has the respective input section substantially orthogonal to the longitudinal axis of the rotor and the respective output section substantially orthogonal with respect to the radial direction of the rotor itself.

In such a way each diffusing duct works as pump section and changes the fibrous substance flow to be treated from an ingoing substantially axial direction to an outgoing substantially radial one.

Externally to the rotor there is a plurality of paddles skimming the basket during the rotation, contributing to keep the filtering surface clean and therefore to keep the filtering power constant in time.

Advantageously the existence of the diverging diffusing ducts, changing the flow from substantially axial to substantially radial, allows an increase in the conveyance speed of the suspension to be treated toward the filtering basket and at the same time it allows the realization of a suction effect so as to improve the filtering output.

Still advantageously a better cleanliness of the filtered suspension and a higher production of "accepted" with the same treatment time can be obtained.

The said aims and advantages will be better pointed out during the description of a preferred embodiment of the invention given approximately but not restrictively and referring to the enclosed drawings where:

Figure 1:
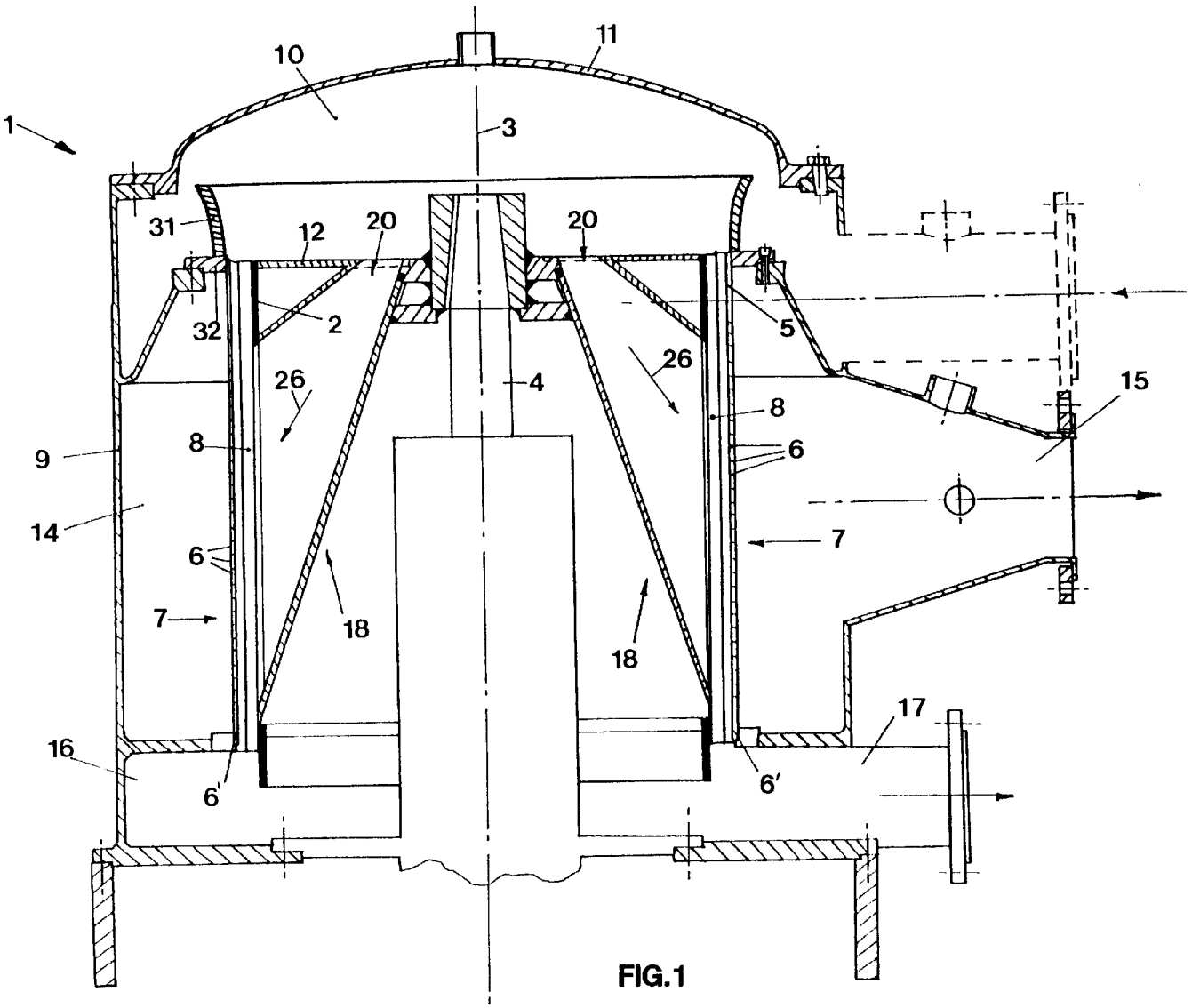
FIG. 1 shows the longitudinal section of the strainer of the invention.

As it can be observed in FIG. 1 the mechanical strainer of the invention, marked with 1 as a whole, includes:

- a substantially cylindrical rotor 2, the longitudinal axis 3 whereof is substantially vertical and provided with a central shaft 4 connected to motorization means, not represented, suitable to impart a rotation to it;
- a filtering basket 5 placed substantially coaxial and external to the rotor 2, provided with a plurality of openings 6 made on its lateral surface 6', the latter being the filtering surface of the strainer, marked with 7 as a whole;
- an interspace 8 defined between the lateral surface of the rotor 2 and the filtering surface 7 of the filtering basket 5;
- an outer casing 9 housing the filtering basket 5 and the rotor 2, in which there are:
  - a feeding chamber 10 included between the lid 11 of the casing 9 and the upper base 12 of the rotor 2, communicating with the interspace 8 and with a feeding piping 13 of the fibrous suspension to be treated;

a delivery chamber 14 defined in the centre of the casing 9 and substantially in correspondence with the filtering surface 7 of the filtering basket 5, communicating with the outer environment through a delivery piping 15;

a waste chamber 16 defined on the bottom of the casing 9, communicating directly with the interspace 8 and through a waste piping 17 with the outer environment.

Figure 2:
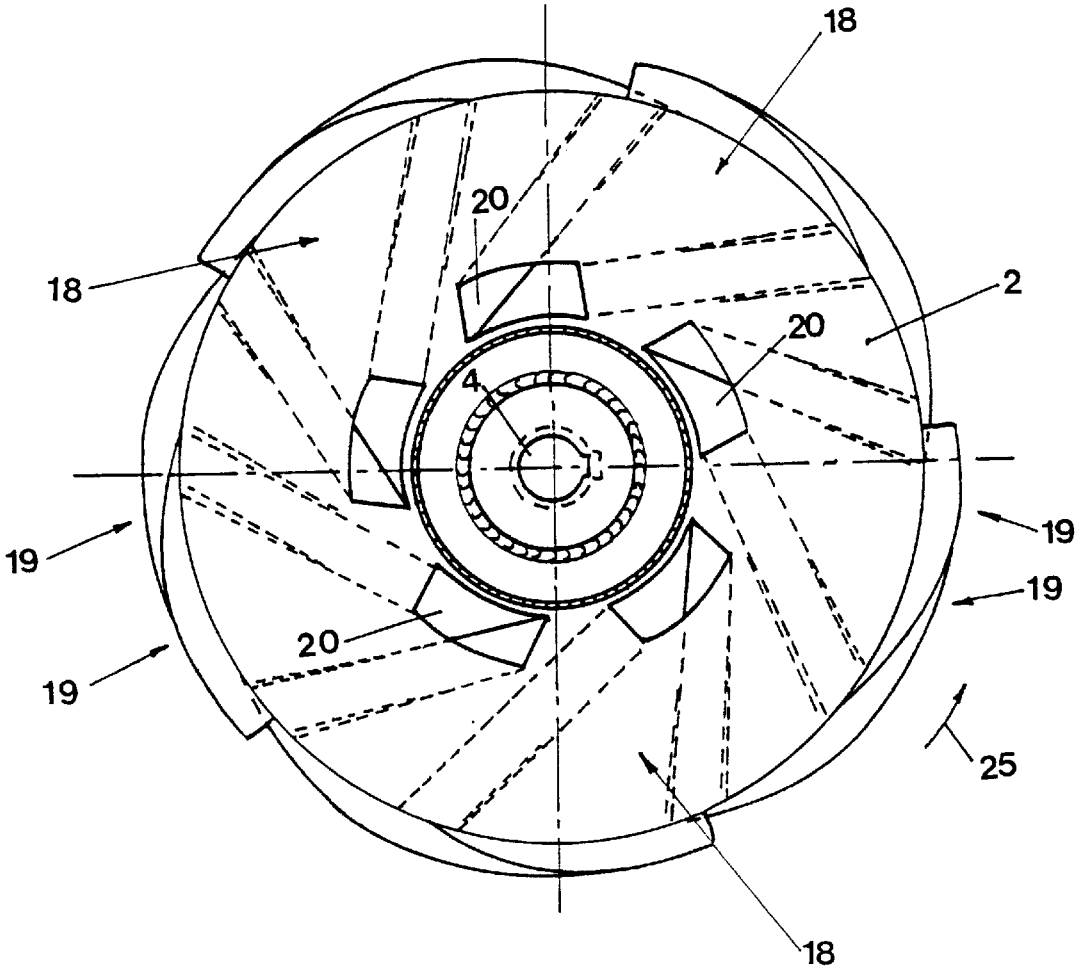
FIG. 2 shows a top view of the rotor of the strainer of FIG. 1.
Figure 3:
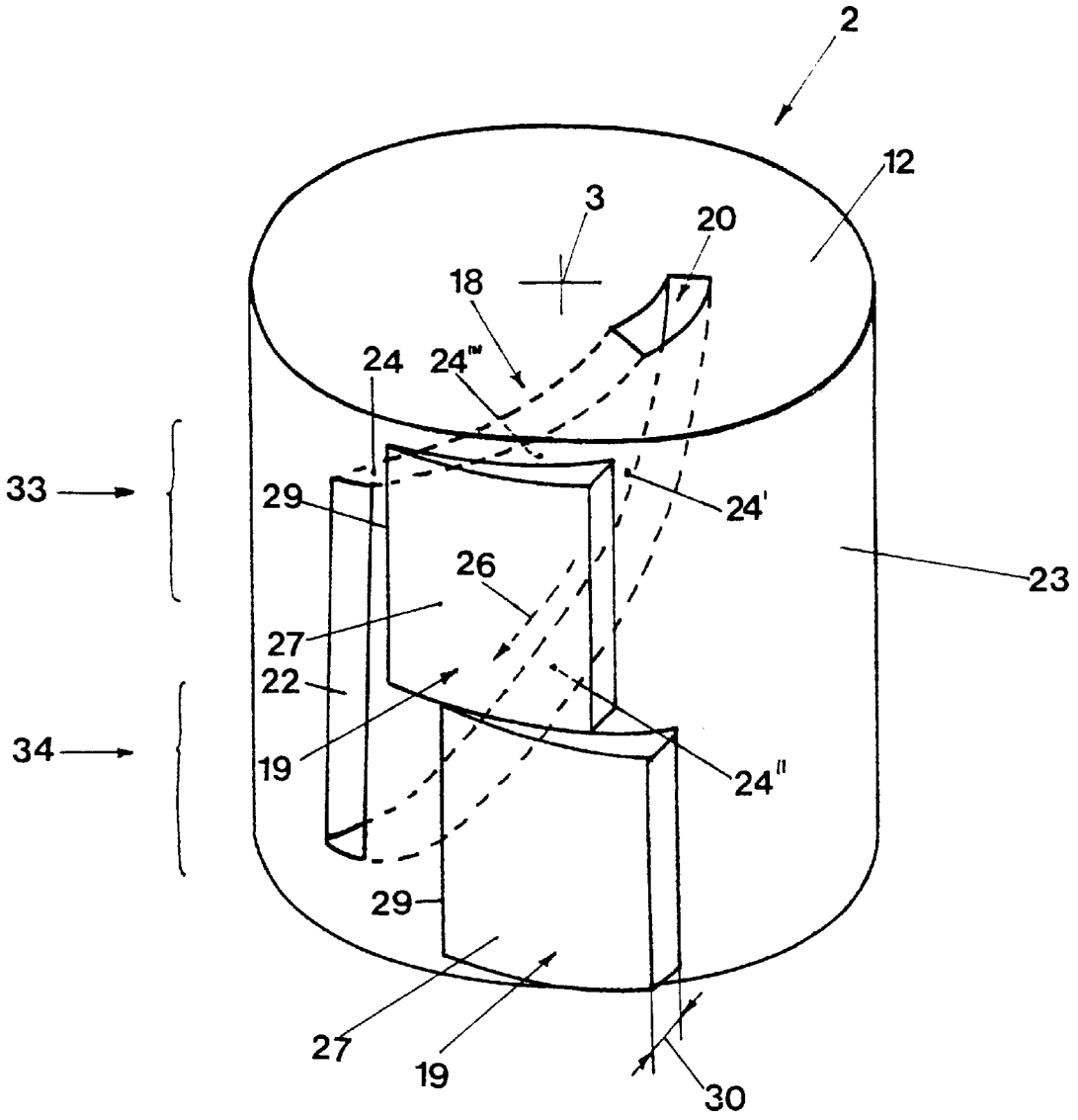
FIG. 3 shows in an axonometric view a schematization of the rotor of FIG. 2.

In FIGS. 2 and 3 it can be observed that the rotor 2 is provided with a plurality of diffusing ducts, each one marked with 18 as a whole and with a plurality of tongues, each one marked with 19 as a whole.

As regards the diffusing ducts 18, they are five in the particular described embodiment and are placed symmetrically with respect to the longitudinal axis 3 of the rotor according to the vertex of a regular pentagon. Each diffusing duct is realized inside the rotor 2 and develops between an input section 20 realized on the upper base 12 of the rotor defining the feeding chamber 10 together with the lid 11, and an output section 22 realized on the lateral surface 23 of the rotor itself cooperating with the filtering surface 7 of the basket 5 in order to define the interspace 8. The body of each diffusing duct 18 is defined by curved surfaces 24, 24', 24", 24'" developing from the respective input section 20 through diverging ways toward the respective output section 22, the latter having a larger area with respect to the input section.

Moreover in each diffusing duct 18 the input section 20 is substantially orthogonal to the longitudinal axis 3 of the rotor and the respective output section 22 is substantially orthogonal to the radial direction of the rotor itself. In such a way each diffusing duct, during the rotation of the rotor 2 according to the direction 25, works substantially as a pump section changing the flow of the suspension to be treated from an ingoing substantially axial direction through the input section 20 to an outgoing substantially radial direction through the output section 22. Moreover the section of the diffusing duct 18 increases continuously toward the direction 26 causing a depression attracting the suspension from the feeding chamber 10. Along the diffusing duct the suspension is broken into fragments and accelerated until being thrown at high speed against the filtering surface 7 of the basket 5.

These effects, combined to one another and obtained through the diffusing ducts 18, realize an increase of the filtering effect of the strainer allowing the filtering of suspensions reaching concentration figures near to 4% without any filtering surface clogging.

The latter in particular is kept clean by couples of tongues 19 external to the rotor skimming the filtering surface 7 during the rotation and realizing the detachment of the material adhering to it, contributing to keep it clean.

In such a way the efficiency of the filtering surface is kept constant in time as well as the filtering effect of the strainer as a whole.

Each tongue 19 has a convex external surface 27 so that its radial section grows beginning from the line 29 of junction to the lateral surface 23 of the rotor until it reaches the greatest width 30, slightly lower to the width of the interspace 8 in which it is housed. In particular it can be observed that said tongues 19 are placed along two annular bands 33 and 34 where the tongues of said annular bands are staggered to one another according to the axial direction.

Inside the feeding chamber 10, as it can be observed in FIG. 1, there is an annular sector 31, fixed to the ring nut 32 connecting the basket 5 to the outer casing 9, projecting axially according to the direction of the longitudinal axis 3 of the strainer with respect to the upper base 12 of the rotor 2. The presence of the annular sector 31 is necessary in order to avoid that possible foreign bodies piped together with the suspension to be depurated in the delivery piping 13, go in the diffusing ducts 18 damaging the strainer.

According to what has been said it can therefore be understood that the strainer of the invention achieves all the prearranged aims.

First of all the aim of realizing a strainer allowing, without clogging, the realization of the purge of fibrous suspensions with higher concentrations with respect to those which are treatable with strainers of a known type is achieved. In particular the strainer of the invention can filter, without clogging, fibrous suspensions with concentrations higher than 2% representing the limit figure for the mechanical strainers of the known type. Precisely by using the strainer of the invention fibrous suspensions with concentrations until 4% can be treated without clogging problems.

Moreover the aim of improving the purge degree of the suspension is obtained too since by increasing the density of the suspension to be treated and the filtering surface being the same, a more purified pulp is obtained.

The aim of improving the performance of the strainer is achieved too since by treating thicker fibrous suspensions, the quantity of "accepted", which can be obtained by the suspension filtering, increases in time.

Of course it will be possible to realize the strainer of the invention with any dimension.

Moreover the diffusing ducts and the tongues it is provided with can have even different shapes than those which have been described and illustrated in the drawings.

In the executive phase it will be possible to introduce structural changes to the invention equipment, not represented in the drawings, which, being a part of the same described resolving idea, are to be considered all protected by the present invention.

What is claimed is:

1. A mechanical strainer for fibrous suspensions including:

a rotor having a substantially vertical longitudinal axis and an upper base, including a central shaft and motorization means suitable to impart a rotation to the shaft;

a filtering basket having a side surface being disposed externally to said rotor and coaxially therewith and having a plurality of openings formed in said side surface;

an interspace defined between the rotor and said filtering basket;

an outer casing for housing said filtering basket and said rotor including:

a feeding chamber defined in an upper part of said casing for communicating the fibrous suspension to be treated with said annular interspace;

a delivery chamber defined externally of said filtering basket, a delivery pipe for communicating between the feeding chamber and the outer environment;

a waste chamber defined in a lower portion of said casing, communicating directly with said interspace, and a waste piping communicating the interspace with the outer environment, wherein said rotor has a plurality of diffusing ducts each one located between an inlet section in the upper base of said rotor defining said feeding chamber and an outlet section in the lateral surface of said rotor defining said interspace, said ducts for piping the fibrous suspension to be treated from said feeding chamber to said interspace, each of said diffusing ducts has a diverging way and is defined laterally by curved surfaces beginning from the respective inlet section through the diverging ways toward the respective outlet section, said outlet section having an area larger than the area of said inlet section.

2. A strainer according to claim 1 wherein each of said diffusing ducts has the respective inlet section substantially orthogonal to the central axis of said rotor and the respective outlet section substantially orthogonal with respect to a radial direction of the rotor, said diffusing ducts for changing the flow of fibrous suspensions from a substantially axial direction in correspondence with said inlet section to a substantially radial direction in correspondence with said outlet section.

3. A strainer according to claim 1, wherein said feeding chamber has an interior annular sector integral with said basket and projecting in the direction of the central axis of said strainer with respect to the upper base of said rotor.

4. A strainer according to claim 3, including a ring nut connecting said filtering basket to the outer casing of said strainer.

5. A strainer according to claim 1 wherein said diffusing ducts are located inside said rotor.

6. A strainer according to claim 1 wherein said diffusing ducts are placed symmetrically with respect to the central axis of said rotor, each one having the inlet section located according to the vertex of a regular pentagon.

7. A strainer according to claim 6 wherein said diffusing ducts comprise five elements.

8. A strainer according to claim 1 including a plurality of tongues extended of said rotor each having a convex outer surface and a radial cross section increasing from an attachment line of the side surface of said rotor.

9. A strainer according to claim 8 wherein said tongues are located on the side surface of said rotor in two annular bands, at least one of said tongues being associated with one of said annular bands staggered with respect to at least one of said tongues being associated with the other annular band.

* * * * *